US010629985B2

(12) United States Patent
Kawano

(10) Patent No.: US 10,629,985 B2
(45) Date of Patent: Apr. 21, 2020

(54) ANTENNA MODULE

(71) Applicant: AISIN SEIKI KABUSHIKI KAISHA, Kariya-shi, Aichi-ken (JP)

(72) Inventor: Masayuki Kawano, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 334 days.

(21) Appl. No.: 15/356,250

(22) Filed: Nov. 18, 2016

(65) Prior Publication Data

US 2017/0250464 A1 Aug. 31, 2017

(30) Foreign Application Priority Data

Feb. 29, 2016 (JP) ..... 2016-037343

(51) Int. Cl.
*H01Q 7/08* (2006.01)
*H01Q 1/32* (2006.01)
(Continued)

(52) U.S. Cl.
CPC ..... *H01Q 1/3283* (2013.01); *H01Q 1/3241* (2013.01); *H01Q 1/42* (2013.01);
(Continued)

(58) Field of Classification Search
CPC ..... H01Q 1/3283; H01Q 1/3241; H01Q 1/42; H01Q 7/06; H01Q 7/08; H01R 4/023; H01R 13/5833
See application file for complete search history.

(56) References Cited

U.S. PATENT DOCUMENTS 6,577,228 B1 * 6/2003 Tsuchida ..... B60R 25/24 340/10.1
2001/0026244 A1 * 10/2001 Ieda ..... H01Q 7/08 343/867
(Continued)

FOREIGN PATENT DOCUMENTS

CN 202444057 U 9/2012
CN 202474217 U 10/2012
(Continued)

OTHER PUBLICATIONS

Extended European Search Report dated Jul. 14, 2017 issued by the European Patent Office in corresponding European Patent Application No. 16194298.2 (8 pages).
(Continued)

*Primary Examiner* — Hai V Tran
*Assistant Examiner* — Bamidele A Jegede
(74) *Attorney, Agent, or Firm* — Buchanan Ingersoll & Rooney PC

(57) ABSTRACT

An antenna module includes: a magnetic core; a first electric wire constituting a coil into which the magnetic core is inserted; a capacitor having first and second terminals and connected in series to the coil; a second electric wire connected to the capacitor; and a base including a capacitor accommodating portion and a core accommodating portion, wherein the capacitor accommodating portion has first and second accommodating portions, the first terminal and a connecting portion of the first electric wire are connected to each other in the first accommodating portion, the second terminal and a connecting portion of the second electric wire are connected to each other in the second accommodating portion, and a portion of an opposite side to the connecting portion in the first electric wire and the second electric wire constitute a harness.

9 Claims, 7 Drawing Sheets

(51) Int. Cl.

| | |
|---|---|
| ***H01Q 1/42*** | (2006.01) |
| ***H01Q 7/06*** | (2006.01) |
| *H01R 4/02* | (2006.01) |
| *H01R 13/58* | (2006.01) |

(52) U.S. Cl.
CPC ..... *H01Q 7/06* (2013.01); *H01Q 7/08* (2013.01); *H01R 4/023* (2013.01); *H01R 13/5833* (2013.01)

(56) References Cited

U.S. PATENT DOCUMENTS

2002/0163474 A1* 11/2002 Ieda ..... H01Q 1/3283 343/742
2004/0222804 A1* 11/2004 Inuzuka ..... E05B 81/76 324/690
2004/0257296 A1* 12/2004 Ieda ..... B60R 25/02 343/872
2004/0262139 A1* 12/2004 Ieda ..... E05B 81/76 200/341
2005/0230237 A1* 10/2005 Ieda ..... E05B 81/78 200/600
2007/0008235 A1* 1/2007 Tsukahara ..... B60R 25/246 343/788
2007/0075828 A1* 4/2007 Mizushima ..... B60R 25/246 340/5.62
2007/0075913 A1* 4/2007 Moriya ..... H01Q 7/06 343/895
2007/0080882 A1* 4/2007 Ohara ..... B60R 11/0264 343/788
2007/0096905 A1* 5/2007 Ieda ..... B60R 25/246 340/562
2007/0115191 A1* 5/2007 Hashiguchi ..... E05B 81/78 343/713
2007/0216174 A1* 9/2007 Tanimoto ..... E05B 81/78 292/336.3
2007/0216175 A1* 9/2007 Tanimoto ..... E05B 81/78 292/336.3
2008/0068129 A1* 3/2008 Ieda ..... B60R 25/246 340/5.72
2008/0100522 A1* 5/2008 Inaba ..... B60R 25/246 343/713
2009/0279826 A1* 11/2009 Ieda ..... B60Q 1/2669 385/13
2009/0284358 A1* 11/2009 Ieda ..... G07C 9/00309 340/425.5
2011/0122046 A1* 5/2011 Yashima ..... H01Q 1/243 343/907
2011/0140479 A1* 6/2011 Okada ..... E05B 81/78 296/146.1
2011/0241957 A1* 10/2011 Ohara ..... H01Q 1/3241 343/788
2014/0210487 A1* 7/2014 Ohara ..... H01Q 1/3283 324/629
2015/0042529 A1* 2/2015 Tanaka ..... H01Q 7/00 343/788
2015/0295315 A1* 10/2015 Tanaka ..... H01Q 1/3241 343/788

FOREIGN PATENT DOCUMENTS

| | | | |
|---|---|---|---|
| JP | 2002-342082 | A | 11/2002 |
| JP | 2007-251886 | A | 9/2007 |
| JP | 2008-078899 | A | 4/2008 |
| JP | 2008-211643 | A | 9/2008 |
| JP | 2013-034254 | A | 2/2013 |
| JP | 2015-204557 | A | 11/2015 |

OTHER PUBLICATIONS

Office Action (Notice of Reasons for Refusal) dated Nov. 12, 2019, by the Japanese Patent Office in corresponding Japanese Patent Application No. 2016-037343 and an English Translation of the Office Action. (6 pages).

* cited by examiner

ANTENNA MODULE

CROSS REFERENCE TO RELATED APPLICATIONS

This application is based on and claims priority under 35 U.S.C. § 119 to Japanese Patent Application 2016-037343, filed on Feb. 29, 2016, the entire contents of which are incorporated herein by reference.

TECHNICAL FIELD

This disclosure relates to an antenna module which is mounted on a door for a vehicle.

BACKGROUND DISCUSSION

As an antenna module built into an outside handle of a door on a vehicle, a technique described in JP 2008-211643A (Reference 1) is known.

The antenna module described in Reference 1 includes a magnetic core, a coil, a capacitor to which the coil is connected, a holding member to which the magnetic core is attached and which holds the capacitor a sealing body, a case in which these are accommodated, and two harnesses. The holding member includes a disposition portion which disposes the capacitor, and two harness terminals which support the two harnesses, respectively. A first harness is connected to a first harness terminal, and a second harness is connected to a second harness terminal. In addition, one end portion of the coil is connected to the first harness terminal and the other end portion of the coil is connected to one side terminal of the capacitor. The other side terminal of the capacitor is connected to the second harness terminal.

Such a connecting structure between a coil, a capacitor and a harness is assumed to include a holding member on which two harness terminals are provided.

SUMMARY

Thus, a need exists for an antenna module which is not susceptible to the drawback mentioned above.

An antenna module according to an aspect of this disclosure includes a magnetic core; a first electric wire which constitutes a coil into which the magnetic core is inserted; a capacitor which has a first terminal and a second terminal and which is connected in series to the coil; a second electric wire which is connected to the capacitor; and a base which includes at least a capacitor accommodating portion in which the capacitor is accommodated and a core accommodating portion in which the magnetic core is accommodated. The capacitor accommodating portion has a first accommodating portion which accommodates at least one portion of the first terminal of the capacitor and a connecting portion of the first electric wire and a second accommodating portion which accommodates at least one portion of the second terminal of the capacitor and a connecting portion of the second electric wire. The first terminal of the capacitor and the connecting portion of the first electric wire are connected to each other in the first accommodating portion. The second terminal of the capacitor and the connecting portion of the second electric wire are connected to each other in the second accommodating portion. A portion of an opposite side to the connecting portion in the first electric wire and the second electric wire constitute a harness.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An example of an application of an antenna module 10 will be illustrated. For example, the antenna module 10 is used as an antenna of a wireless device mounted on a vehicle.

The wireless device constitutes a portion of an entry system (system that is capable of locking and unlocking of a door for a vehicle through wireless communication). The wireless device includes a main body device, an antenna that sends and receives a wireless signal, and a portable device that performs wireless communication with the main body device through the antenna. For example, the main body device sends a request signal through the antenna and detects a position of the portable device based on reception of a response signal that is sent when the portable device receives the request signal. The antenna module 10 is used to an antenna of such a system.

Figure 1:
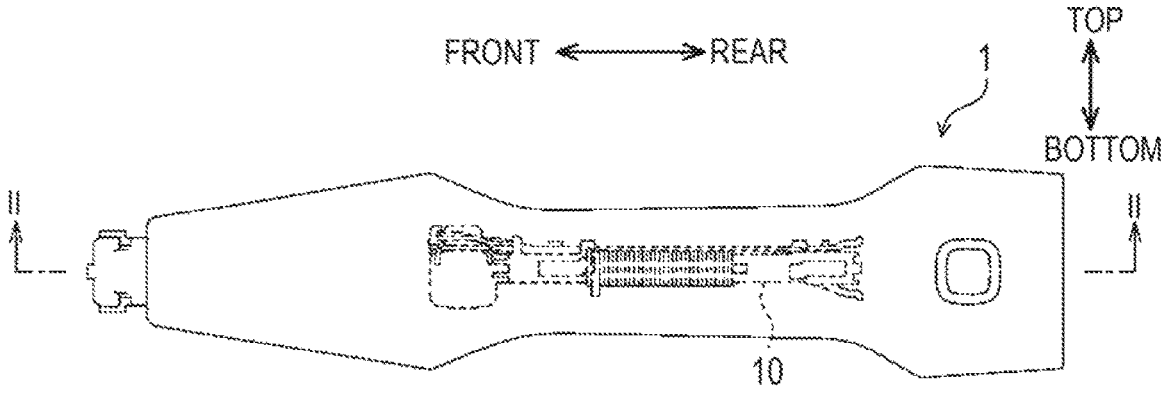
FIG. 1 is a plan view illustrating an outside handle.
Figure 2:
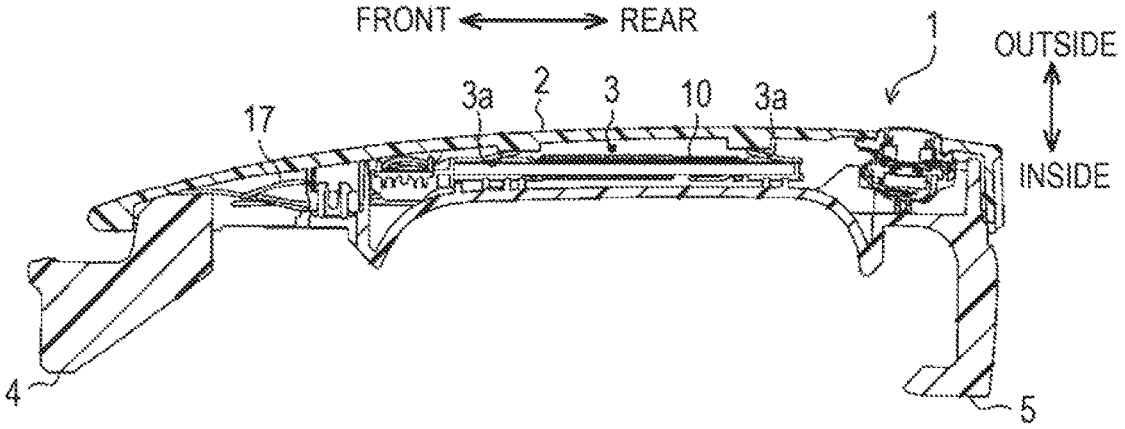
FIG. 2 is a cross-sectional view illustrating the outside handle taken along line II-II of FIG. 1.

As illustrated in FIG. 1 and FIG. 2, the antenna module 10 is disposed in an outside handle 1 of the door for a vehicle. The outside handle 1 includes a grip portion 2 which includes a module accommodating chamber 3 in which the antenna module 10 is accommodated, a first projecting portion 4 which projects from an end portion of the grip portion 2, and a second projecting portion 5 which projects from the other end portion of the grip portion 2. The first projecting portion 4 is engaged to the door for a vehicle through a rotating shaft. The second projecting portion 5 is engaged to a bell crank disposed on a door side for a vehicle. The bell crank causes a looking mechanism (mechanism that controls locking of the door for a vehicle) which is mounted on the door for a vehicle to be operated by an operation thereof.

A harness 17 (harness that is constituted by a first electric wire 13 and a second electric wire 14 to be described below) of the antenna module 10 passes through an insertion hole provided to the outside handle 1, is disposed in the door for a vehicle, and then is connected to the main body device or a relay device in the door for a vehicle. The relay device is a device that relays the main body device and the antenna module 10.

First Embodiment

With reference to FIG. 3 to FIG. 10, an example of an antenna module 10 will be illustrated.

A longitudinal direction, a vehicle width direction and a vertical direction of the antenna module 10 are defined based on disposition when the antenna module 10 is mounted on the outside handle 1 of the door for a vehicle. Specifically, "a front side" and "a rear side" of the antenna module 10 match with a front side and a rear side of a vehicle. "An inside" in the antenna module 10 indicates a direction that faces an inside of a vehicle in the vehicle width direction. "An outside" in the antenna module 10 indicates a direction opposite to the inside. In the antenna module 10, "a top" indicates a top when the antenna module 10 is mounted on the outside handle 1 of the door for a vehicle. "A bottom" is a side opposite to "the top".

Figure 3:
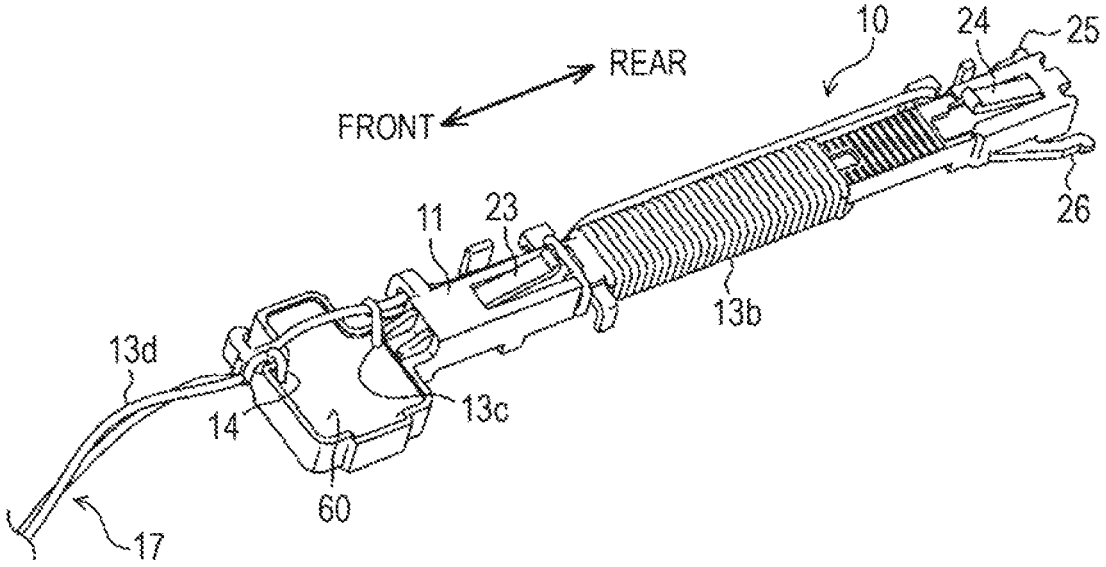
FIG. 3 is a perspective view illustrating an antenna module according to a first embodiment.
Figure 4:
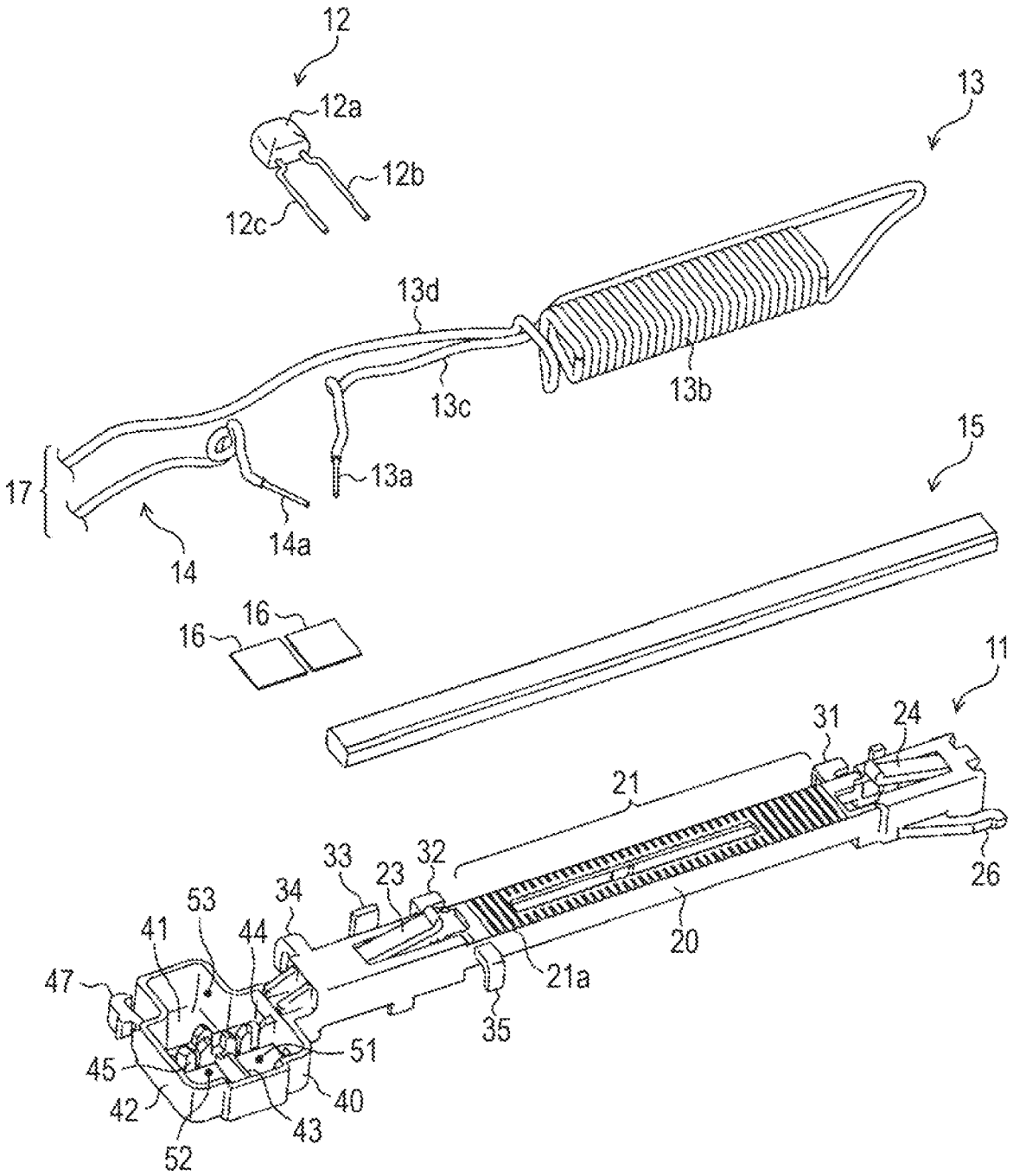
FIG. 4 is an exploded perspective view illustrating the antenna module according to the first embodiment.
Figure 5:
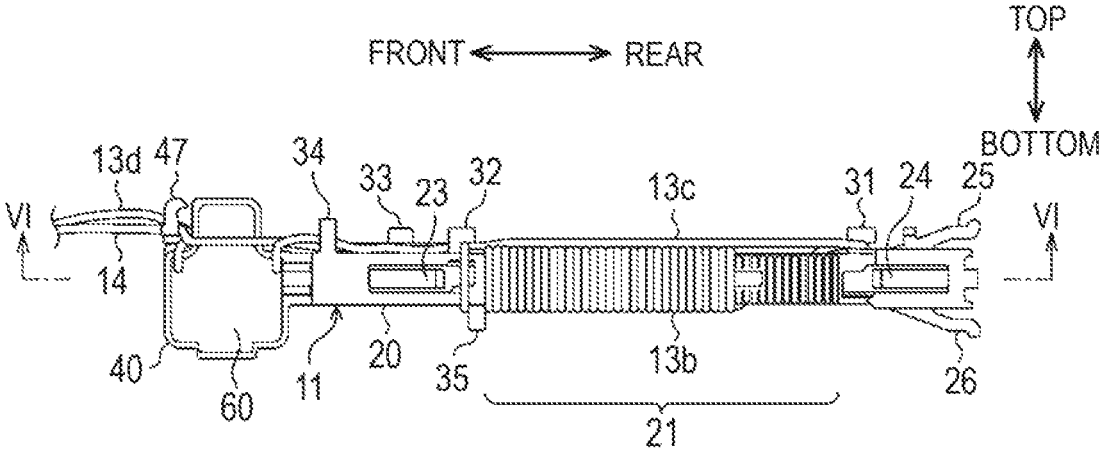
FIG. 5 is a plan view illustrating the antenna module according to the first embodiment.

As illustrated in FIG. 3 and FIG. 4, the antenna module 10 includes a base 11, a capacitor 12, a first electric wire 13 which includes a coil 13*b*, a second electric wire 14, and a magnetic core 15. The magnetic core 15 has a rod shape and is inserted into the coil 13*b*. The magnetic core 15 is made from ferrite, for example. The capacitor 12 and the coil 13*b* are connected in series to each other. In other words, the antenna module 10 constitutes a series LC circuit. The capacitor 12 includes a main body portion 12*a*, and two lead terminals that extend from the main body portion 12*a* (hereinafter, two lead terminals are referred to as "a first terminal 12*b*" and "a second terminal 12*c*").

The first electric wire 13 and the second electric wire 14 include conductors made from copper or the like, and coating layers coating the conductors. The coating layer has both insulation properties and waterproof properties. The conductors in both ends of the first electric wire 13 and the second electric wire 14 are exposed and one side ends thereof are connected to the capacitor 12 and the other side ends thereof are connected to a connector. Hereinafter, in the first electric wire 13, the exposed conductor end which is connected to the capacitor 12 is referred to as "a connecting portion 13*a*".

With reference to FIG. 5 to FIG. 8, the base 11 will be described.

The base 11 includes a portion in which the magnetic core 15 is accommodated (hereinafter, it is referred to as "a core accommodating portion 20") and a portion in which the capacitor 12 is accommodated (hereinafter, it is referred to as "a capacitor accommodating portion 40"). The capacitor accommodating portion 40 is disposed on a front side of the core accommodating portion 20. The base 11 is made from resin.

Figure 6:
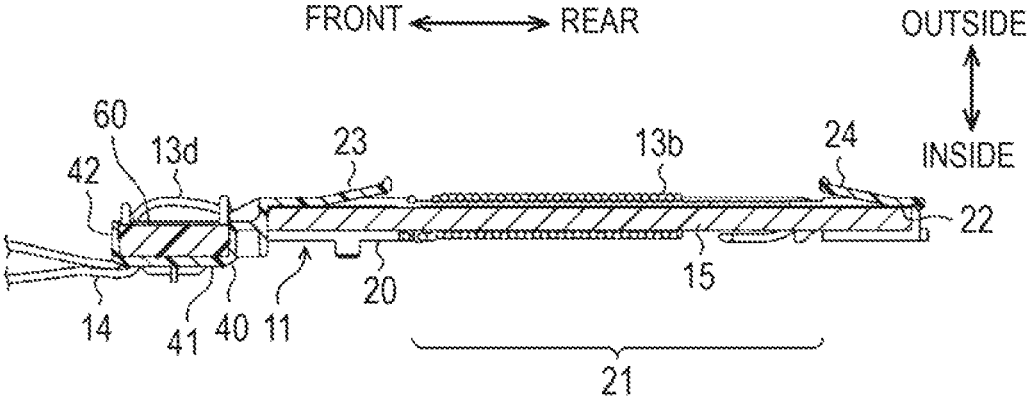
FIG. 6 is a cross-sectional view illustrating the antenna module taken along line VI-VI of FIG. 5.
Figure 7:
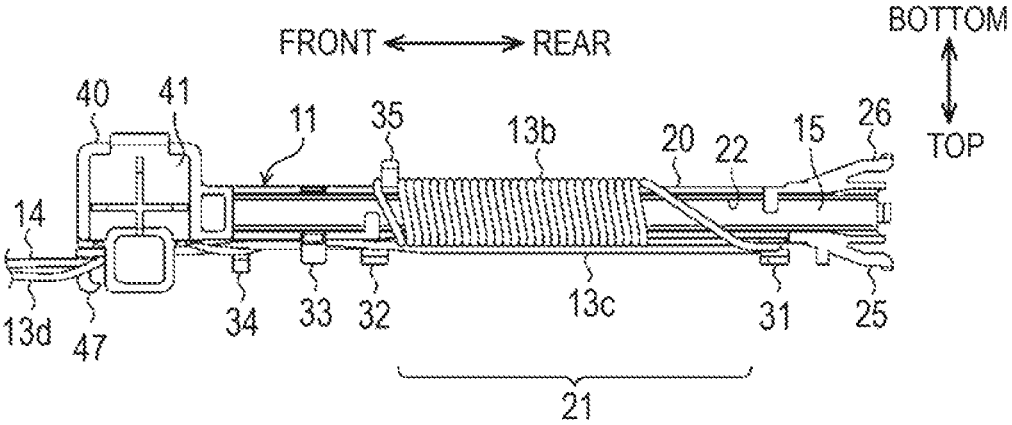
FIG. 7 is a bottom view illustrating the antenna module according to the first embodiment.

As illustrated in FIG. 6 and FIG. 7, the core accommodating portion 20 has a concave portion 22 in which the magnetic core 15 is accommodated. The first electric wire 13 is spirally wound around an intermediate side of a portion (hereinafter, it is simply referred to as "an intermediate portion 21") on which the magnetic core 15 is disposed on the core accommodating portion 20. A portion around which the first electric wire 13 is wound becomes the coil 13*b* described above.

A guide groove 21*a* (see FIG. 4) which guides the first electric wire 13 in order to be spirally wound is provide to the intermediate portion 21 of the core accommodating portion 20.

A first claw 23 is provided closer to a front side than the intermediate portion 21 in an outer surface (surface that faces the outside in the vehicle width direction) of the core accommodating portion 20. A second claw 24 is provided closer to a rear side than the intermediate portion 21 in an outer surface of the core accommodating portion 20. The first claw 23 and the second claw 24 are in contact with an inside surface 3*a* (surface that faces an inside in the vehicle width direction; see FIG. 2) of a contacting portion in the module accommodating chamber 3.

A third claw 25 and a fourth claw 26 are provided to side surfaces (upper surface and low surface) in the core accommodating portion 20. The third claw 25 and the fourth claw 26 are in contact with the side surfaces (upper surface or low surface) of the module accommodating chamber 3. Each of the first claw 23 to the fourth claw 26 has elastic properties and is configured to be bent when proximal end portion thereof is in contact with the module accommodating chamber 3. In this way, the antenna module 10 is held in the module accommodating chamber 3 in order not to generate position shift due to vibrations or shocks.

In addition, five guide claws (hereinafter, they are referred to as "a first guide claw 31" to "a fifth guide claw 35", respectively) are provided in the core accommodating portion 20 in order to guide the first electric wire 13. The first guide claw 31 to the fourth guide claw 34 project from one side surface of the core accommodating portion 20, and the fifth guide claw 35 projects from the other side surface of the core accommodating portion 20. Then, the first guide clew 31 is disposed closer to the rear side than the coil 13*b* and the second guide claw 32 to the fifth guide claw 35 are further disposed closer to the front side than the coil 13*b*. In addition, the second guide claw 32 to the fourth guide claw 34 are disposed in the order of the second guide claw 32, the third guide claw 33, and the fourth guide claw 34 from the core accommodating portion 20 toward the capacitor accommodating portion 40. The fifth guide claw 35 is disposed closer to the coil 13*b* side than the second guide claw 32 in the longitudinal direction of the core accommodating portion 20. The first guide claw 31 to the fifth guide claw 35 are configured in a hook shape so that the first electric wire 13 is hooked therein. For example, the first guide claw 31 to the fifth guide claw 35 are bent in a right angle shape or acute angle shape so that the first electric wire 13 is hooked therein.

The first electric wire 13 is divided into the coil 13*b*, a portion that extends from a rear side end of the coil 13*b* (hereinafter, it is referred to as "a first extending portion 13*c*"), and a portion that extends from a front side end of the coil 13*b* (hereinafter, it is referred to as "a second extending portion 13*d*").

The first extending portion 13*c* includes the connecting portion 13*a* described above. The first extending portion 13*c* is firstly wired to be directed in the rear side direction and the extending direction thereof is reversed at the first guide claw 31. Subsequently, the first extending portion 13*c* is engaged to the second guide claw 32, the third guide dew 33, and the fourth guide claw 34 in this order and is guided to the second guide claw 32, the third guide claw 33, and the fourth guide claw 34 and thus the connecting portion 13*a* thereof is disposed on the first accommodating portion 51 of the capacitor accommodating portion 40 (see FIG. 3 to FIG. 7).

The second extending portion 13*d* is engaged to the fifth guide claw 35, the second guide claw 32, the third guide claw 33, and the fourth guide claw 34 in this order and is guided to the fifth guide claw 35, the second guide claw 32, the third guide claw 33, and the fourth guide claw 34 and thus is guided to a guide claw 47 to be described below provided to the capacitor accommodating portion 40 (see FIG. 3 and FIG. 4). The second extending portion 13*d* constitutes a portion of the harness 17.

Figure 8:
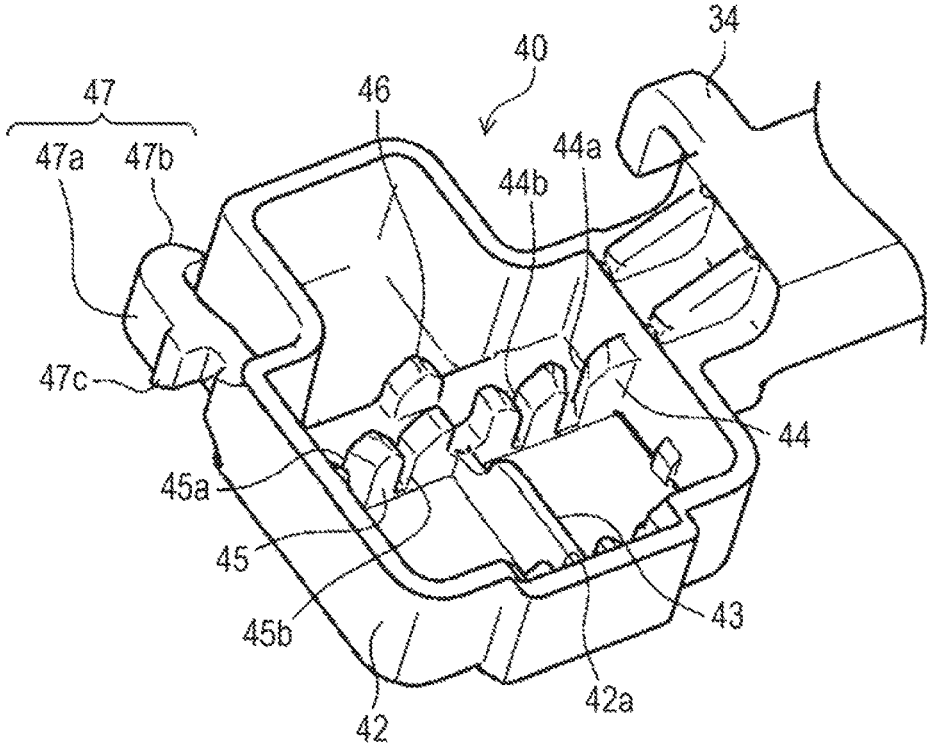
FIG. 8 is a perspective view illustrating a capacitor accommodating portion.
Figure 9:
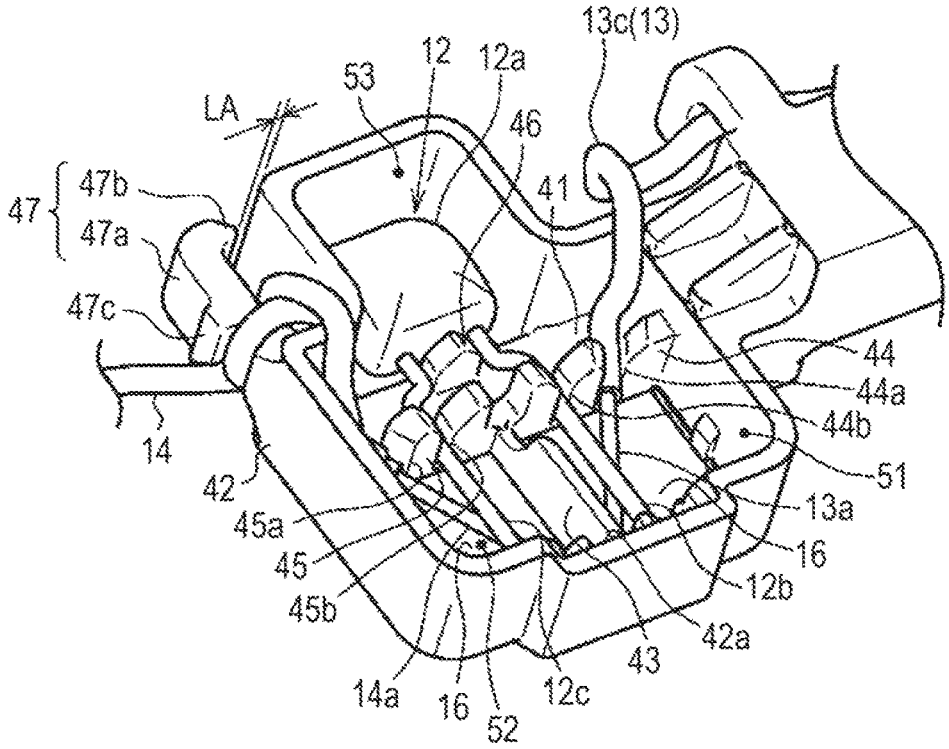
FIG. 9 is a perspective view illustrating the capacitor accommodating portion in which a capacitor is accommodated.
Figure 10:
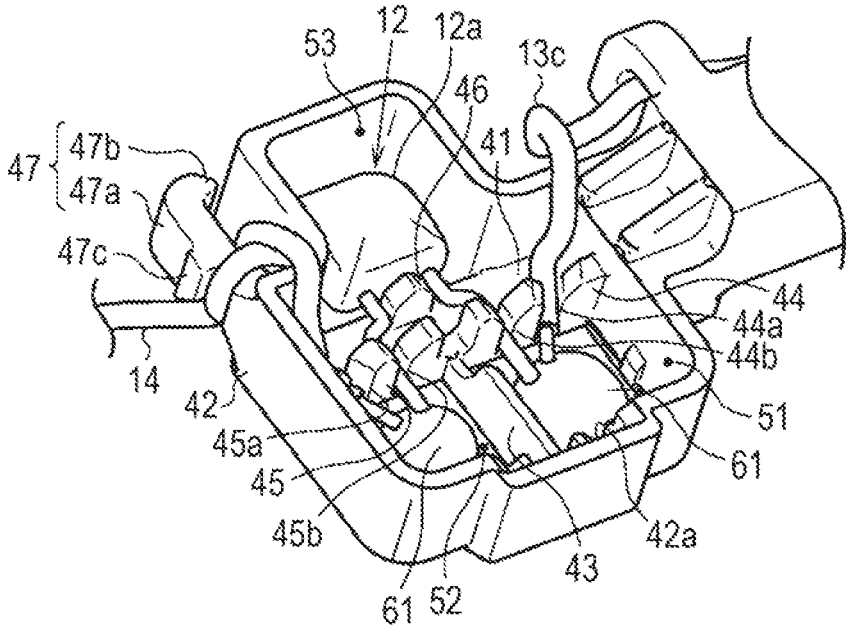
FIG. 10 is a perspective view illustrating the capacitor accommodating portion in which the capacitor and an electric wire are connected by soldering.

With reference to FIG. 8 to FIG. 10, the capacitor accommodating portion 40 will be described.

The capacitor accommodating portion 40 accommodates the capacitor 12. Preferably, further, a land member 16 is disposed on the capacitor accommodating portion 40 (see FIG. 9). The land member 16 is made from a metal plate (for example, copper plate) or a plate including a metal layer (for example, copper substrate). The land member 16 is used as a substrate for filling solder 61 which connects the terminal of the capacitor 12 with the connecting portions 13*a* and 14*a* of the electric wires 13 and 14.

The capacitor accommodating portion 40 includes a first accommodating portion 51 in which a portion of the first terminal 12*b* of the capacitor 12 is accommodated, a second accommodating portion 52 in which a portion of the second terminal 12*e* of the capacitor 12 is accommodated, and a third accommodating portion 53 in which the main body portion 12*a* of the capacitor 12 is accommodated. Preferably, the land members 16 are disposed on the first accommodating portion 51 and the second accommodating portion 52, respectively.

For example, the capacitor accommodating portion 40 includes a bottom wall 41, and a peripheral wall 42 which is provided in order to surround the bottom wall 41. A space having a box shape which is constituted by the bottom wall 41 and the peripheral wall 42 is divided into the first accommodating portion 51, the second accommodating portion 52 and the third accommodating portion 53, described above. A concave portion 42*a* on which a proximal end of the first terminal 12*b* and a proximal end of the second terminal 12*c* are disposed is provided to a wall portion by which the first accommodating portion 51 and the second accommodating portion 52 are constituted in the peripheral wall 42.

A partition wall 43 is provided between the first accommodating portion 51 and the second accommodating portion 52. A first holding portion 44 in which the first terminal 12*b* and the first electric wire 13 are held is provided between the third accommodating portion 53 and the first accommodating portion 51. A second holding portion 45 in which the second terminal 12*c* and the second electric wire 14 are held is provided between the third accommodating portion 53 and the second accommodating portion 52. Further, a projecting portion 46 that vertically projects from the bottom wall 41 is provided to the third accommodating portion 53. The projecting portion 46 is inserted between a base of the first terminal 12*b* and a base of the second terminal 12*c* (see FIG. 9) and thus the main body portion 12*a* of the capacitor 12 is positioned.

The first holding portion 44 includes a groove into which the first electric wire 13 is inserted (hereinafter, it is referred to as "a groove 44*a* for the first electric wire") and a groove into which the first terminal 12*b* of the capacitor 12 is inserted (hereinafter, it is referred to as "a groove 44*b* for the first terminal). A groove width of the groove 44*b* for the first terminal is equal to or slightly less than a diameter of the first terminal 12*b* and the groove width thereof is widen toward an opening side (side opposite to the bottom wall 41. Hereinafter, the same). A groove width of the groove 44*a* for the first electric wire is equal to or slightly less than a diameter (a diameter of a portion that has a conductor and a coating resin layer) of the first electric wire 13 and the groove width thereof is widen toward the opening side. In addition, preferably, an extending direction (an extending direction of an intersecting line between a surface of one side of a pair of surfaces parallel to each other constituting the groove 44*a* and a surface that is constituted by the bottom wall 41 with each other) of the groove 44*a* for the first electric wire and an extending direction of the groove 44*b* for the first terminal intersect with each other. Further, an intersecting portion between the extending direction of the groove 44*a* for the first electric wire and the extending direction of the groove 44*b* for the first terminal with each other is preferably in the first accommodating portion 51 (hereinafter, this structure is referred to as "a first intersecting structure").

The second holding portion 45 includes a groove into which the second electric wire 14 is inserted (hereinafter, it is referred to as "a groove 45*a* for the second electric wire") and a groove into which the second terminal 12*c* of the capacitor 12 is inserted (hereinafter, it is referred to as "a groove 45*b* for the second terminal"). A groove width of the groove 45*b* for the second terminal is equal to or slightly less than a diameter of the second terminal 12*c* and the groove width thereof is widen toward the opening side. A groove width of the groove 45*a* for the second electric wire is equal to or slightly less than a diameter of the second electric wire 14 and the groove width thereof is widen toward the opening side. In addition, preferably, an extending direction of the groove 45*a* for the second electric wire and an extending direction of the groove 45*b* for the second terminal intersect with each other (see FIG. 9). Further, an intersecting portion between the extending direction of the groove 45*a* for the second electric wire and the extending direction of the groove 45*b* for the second terminal with each other is preferably in the second accommodating portion 52 (hereinafter, this structure is referred to as "a second intersecting structure").

As illustrated in FIG. 9, the first terminal 12*b* of the capacitor 12 is inserted into the groove 44*b* for the first terminal and a portion of the first terminal 12*b* is disposed on the first accommodating portion 51. A coating portion of the first electric wire 13 is inserted into the groove 44*a* for the first electric wire and the connecting portion 13*a* is disposed on the first accommodating portion 51. Then, preferably, in the first intersecting structure described above, the first terminal 12*b* and the connecting portion 13*a* of the first electric wire 13 are disposed to be intersected with each other.

In addition, in the same manner, the second terminal 12*c* of the capacitor 12 is inserted into the groove 45*b* for the second terminal and a portion of the second terminal 12*c* is disposed on the second accommodating portion 52. A coating portion of the second electric wire 14 is inserted into the groove 45*a* for the second electric wire and the connecting portion 14*a* is disposed on the second accommodating portion 52. Then, preferably, in the second intersecting structure described above, the second terminal 12*c* and the connecting portion 14*a* of the second electric wire 14 are disposed to be intersected with each other.

As illustrated in FIG. 10, the terminals 12*b* and 12*c* of the capacitor 12 and the connecting portions 13*a* and 14*a* of the electric wires 13 and 14 are connected by soldering with each other. Preferably, the land member 16 is used in the soldering connection between the terminals 12*b* and 12*c* of the capacitor 12 and the connecting portions 13*a* and 14*a* of the electric wires 13 and 14 with each other. For example, the connecting portion 13*a* of the first electric wire 13 and the first terminal 12*b* of the capacitor 12 are disposed to be intersected on the land member 16 with each other. Then, the solder 61 is filled in the land member 16 so that at least the intersecting portion is covered with the solder 61. A soldering connection structure between the connecting portion 14*a* of the second electric wire 14 and the second terminal 12*c* of the capacitor 12 is also the same as the soldering connection structure of the connecting portion 13*a* of the first electric wire 13 and the first terminal 12*b* of the capacitor 12.

A sealing resin 60 seals between the connecting portions 13*a* and 14*a* (that is, the exposed connector end) of the electric wires 13 and 14 and the terminals of the capacitor 12. Specifically, the sealing resin 60 is filled in the capacitor accommodating portion 40 and the entirety of the capacitor 12 is sealed with the sealing resin 60 (see FIG. 3).

In addition, the guide claw 47 for winding the second electric ware 14 is provided in the capacitor accommodating portion 40.

The guide claw 47 includes a base portion 47*a* which extends from the peripheral wall 42 to an outside (an opposite side to the peripheral wall 42), a protruding portion 47*b* that extends from the base portion 47*a*, and an escaping prevention portion 47*c*. The protruding portion 47*b* of the guide claw 47 is provided to approach to the portion of the peripheral wall 42. Then, an end surface of the protruding portion 47*b* is disposed near to the peripheral wall 42, and a width length LA of a gap between a proximal end of the protruding portion 47*b* and the peripheral wall 42 is set to a distance into which the second electric wire 14 is enough to be inserted. The escaping prevention portion 47*c* is provided to project from the base portion 47*a* at the position which is spaced apart by a predetermined distance (for example, length which is two times of diameter of the second electric wire 14) from the base of the base portion 47*a*. Such an escaping prevention portion 47*c* prevents the second electric wire 14 wound near to the base of the base portion 47*a* from escaping from the guide claw 47.

The second electric wire 14 is supported to the capacitor accommodating portion 40 by winding around the guide claw 47. Then, the connecting portion 14*a* of the second electric wire 14 is connected by soldering the second terminal 12*c* of the capacitor 12 disposed on the second accommodating portion 52 as described above.

An extending portion which extends from a portion engaged to the guide claw 47 in the second extending portion 13*d* of the first electric wire 13, and an extending portion which extends from a portion wound around the guide claw 47 in the second electric wire 14 constitute the harness 17. A connector is attached to a distal end portion of the harness 17.

An operation of the antenna module 10 will be illustrated.

The antenna module of the related art is constituted by the coil and a different member from the harness. Then, one side end portion of the coil is directly connected to the electric wire of one side which constitutes the harness or is connected via a conductor component. In contrast, in the antenna module 10 having the configuration described above, the first electric wire 13 includes a coil 13*b* and a second extending portion 13*d* which extends from the coil 13*b*, and the second extending portion 13*d* acts as an electric wire constituting the harness 17. In this way, a connecting structure between the coil and the harness which was present in the structure of the related art is not present in the antenna module 10 configured as described above. Accordingly, the structure of the antenna module 10 configured as described above is simple compared to the structure of the related art.

An effect of the antenna module 10 will be illustrated.

(1) In the embodiment as described above, the antenna module 10 includes the first electric wire 13 which has the coil 13*b*. Then, the first terminal 12*b* of the capacitor 12 and the connecting portion 13*a* of the first electric wire 13 are connected in the first accommodating portion 51. In addition, the second extending portion 13*d* of the first electric wire 13 (that is, a portion opposite to the connecting portion 13*a* in the first electric wire 13) and the second electric wire 14 constitute the harness 17. In this way, the structure of the antenna module 10 of the present embodiment is simple compared to the structure of the antenna module of the related art.

(2) In the embodiment as described above, the first holding portion 44 is provided between the third accommodating portion 53 and the first accommodating portion 51. The first holding portion 44 holds the first terminal 12*b* of the capacitor 12 and the first electric wire 13. The second holding portion 45 is provided between the third accommodating portion 53 and the second accommodating portion 52. The second holding portion 45 holds the second terminal 12*c* of the capacitor 12 and the second electric wire 14. According to the configuration, when connecting by soldering, there is no need to hold the terminal of the capacitor 12 and the electric wire by a hand. In other words, this configuration contributes to simplification of the manufacturing process.

For example, as described above, the first holding portion 44 includes a groove 44*b* for the first terminal in which the first terminal 12*b* of the capacitor 12 is clamped and a groove 44*a* for the first electric wire in which the first electric wire 13 is clamped. The second holding portion 45 includes a groove 45*b* for the second terminal in which the second terminal 12*c* of the capacitor 12 is clamped and a groove 45*a* for the second electric wire in which the second electric wire 14 is clamped.

(3) Further, preferably, the extending direction of the groove 44*b* for the first terminal and the extending direction of the groove 44*a* for the first electric wire are intersected with each other and the extending direction of the groove 45*b* for the second terminal and the extending direction of the groove 45*a* for the second electric wire are intersected with each other. According to the configuration, the terminals of the capacitor 12 and the connecting portions 13*a* and 14*a* of the electric wires 13 and 14 are connected to each other well. Particularly, in a case where the terminals of the capacitor 12 and the connecting portions 13*a* and 14*a* of the electric wires 13 and 14 are connected by soldering, there is an advantage that soldering operation is simplified since both the terminals of the capacitor 12 and the connecting portions 13*a* and 14*a* of the electric wires 13 and 14 are likely to be filled with solder 61.

(4) In addition, the capacitor accommodating portion 40 is filled with the sealing resin 60. By this, water is prevented from being attached to the capacitor 12 and the connecting portions 13*a* and 14*a* of the electric wires 13 and 14 and, as a result, the first terminal 12*b* and the second terminal 12*c* of the capacitor 12, the first electric wire 13, the second electric wire 14, and the connecting portions 13*a* and 14*a* thereof are prevented from being degraded from by oxidation.

(5) In the embodiment, the second electric wire 14 is wound around the guide claw 47 of the capacitor accommodating portion 40.

When the end of the harness 17 is connected to another device, there is a fear that the harness 17 is pulled. When the harness 17 is pulled, stress is applied to a soldering connection portion between the connecting portion 14*a* of the second electric wire 14 and the second terminal 12*c* of the capacitor 12 through the second electric wire 14. Therefore, there is a fear that cracking (cracking of solder 61) or peeling (peeling between the connecting portion 14*a* of the second electric wire 14 and solder 61 or peeling of the sealing resin 60) is generated in the soldering connection portion. At this point, according to the configuration described above, when the harness 17 is pulled, since a portion wound around the guide claw 47 comes to tighten in the second electric wire 14, a force is unlikely to be applied to a portion from the guide claw 47 to the second terminal 12*c* of the capacitor 12 in the second electric wire 14 and a stress applied to the soldering connection portion between the connecting portion 14*a* of the second electric wire 14 and the second terminal 12*c* of the capacitor 12 is reduced. Therefore, cracking or peeling of the solder 61, or peeling of resin is prevented from generating at the soldering connection portion due to pulling of the harness 17. When a force is applied to the first electric wire 13, since the coil 13*b* is tightened, a stress is unlikely to generate on the soldering connection portion between the connecting portion 13*a* of the first electric wire 13 and the first terminal 12*b* of the capacitor 12.

(6) In addition, in the present embodiment, the base 11 is configured as an integral component with the capacitor accommodating portion 40 and the core accommodating portion 20. Therefore, the antenna module 10 has a less number of components compared to being configured as separated bodies, and has an advantage in terms of component management.

Second Embodiment

Figure 11:
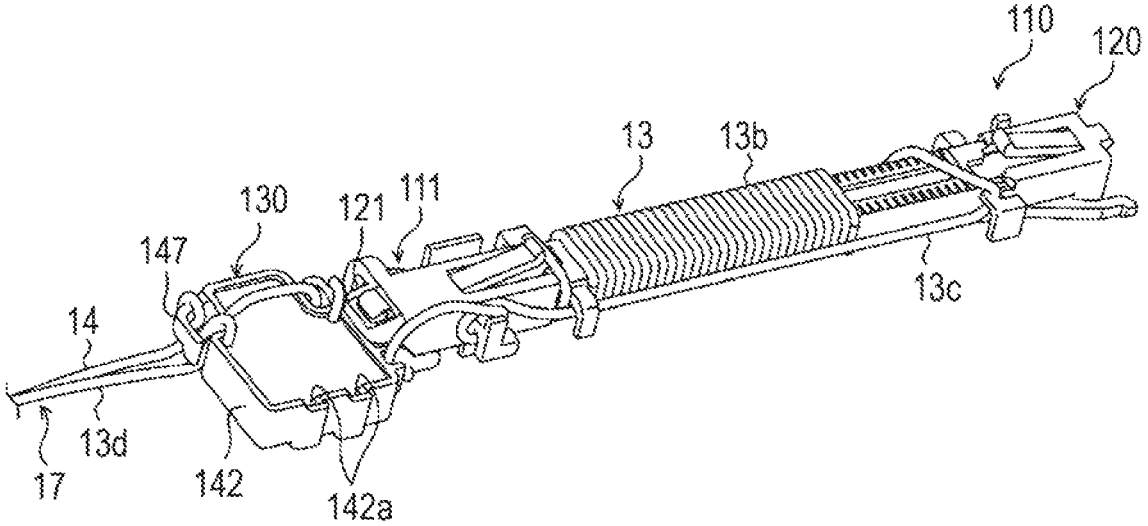
FIG. 11 is a perspective view illustrating an antenna module according to a second embodiment.

With reference to FIG. 11 and FIG. 12, another example of an antenna module 110 will be illustrated.

The antenna module 110 according to the present embodiment is different from the antenna module 10 according to the first embodiment in that base 111 is divided into a portion that includes the core accommodating portion 20 and a portion that includes the capacitor accommodating portion 40. Hereinafter, this point will be described. In the present embodiment, the same structures as those in the antenna module 10 according to the first embodiment will be described while being denoted by the same reference numerals as those in the antenna module 10 according to the first embodiment.

The base 111 is constituted by a first member 120 which includes a portion (core accommodating portion 20) in which the magnetic core 15 is accommodated and a second member 130 which includes a portion (capacitor accommodating portion 40) in which the capacitor 12 is accommodated.

Figure 12A:
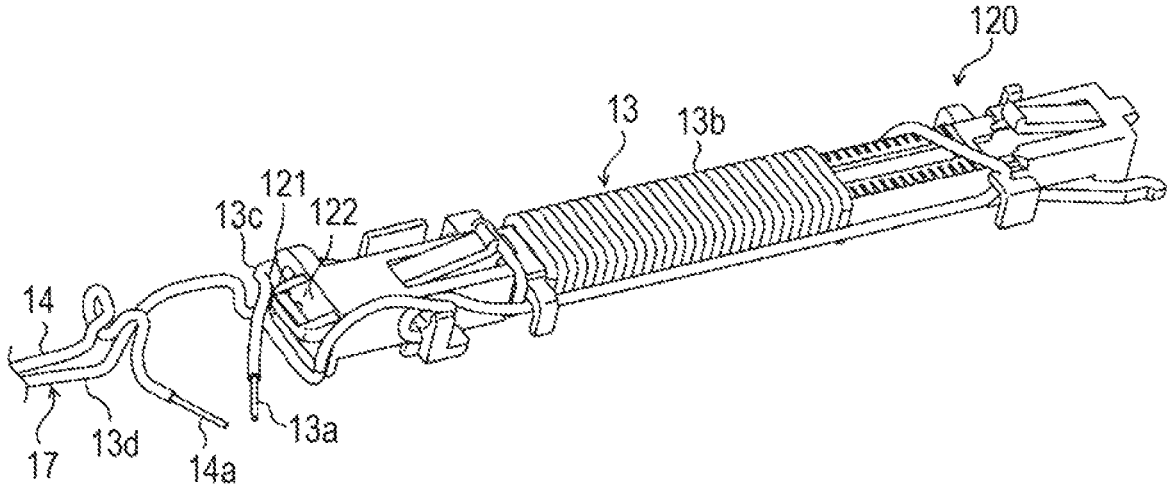
FIG. 12A is a perspective view illustrating a structural body in which a first member is included of the antenna module according to the second embodiment.

As illustrated in FIG. 12A, the first member 120 includes a first engaging portion 121 to which the second member 130 is engaged. The first engaging portion 121 includes a through hole 122 and projects to the second member 130 side in the first member 120.

Figure 12B:
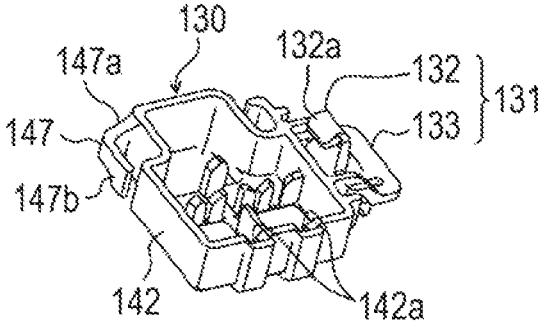
FIG. 12B is a perspective view illustrating a second member of the antenna module according to the second embodiment.

As illustrated in FIG. 12B, the second member 130 includes a second engaging portion 131 which engages to the first engaging portion 121 of the first member 120.

The second engaging portion 131 is provided to project to the first member 120 side in the second member 130. For example, the second engaging portion 131 is constituted by an engaging claw 132 which is inserted into the through hole 122 of the first engaging portion 121 and a contacting portion 133 which is disposed on a periphery of the engaging claw 132. The engaging claw 132 has a barb portion 132*a*. The barb portion 132*a* is engaged to the peripheral portion of the through hole 122 in the first engaging portion 121. When the engaging claw 132 is inserted into the through hole 122, the barb portion 132*a* is in contact with one side surface of the first engaging portion 121 and the contacting portion 133 is in contact with another surface side (a side surface opposite to the one side surface) of the first engaging portion 121. According to the structure, engagement between the first engaging portion 121 and the second engaging portion 131 is unlikely to be deviated.

In the present embodiment, a concave portion 142*a* which separately holds the first terminal 12*b* and the second terminal 12*c* of the capacitor 12 is provided in the second member 130. Therefore, the first terminal 12*b* is positioned at a predetermined place of the first accommodating portion 51 and, in addition, the second terminal 12*c* is positioned at a predetermined place of the second accommodating portion 52. In addition, in this embodiment, a guide claw 147 which guides the second electric wire 14 includes a base portion 147*a* and a protruding portion 147*b* that extends from the base portion 147*a*. The base portion 147*a* extends from a portion of a main body portion 12*a* side of the capacitor 12 in a peripheral wall 142 which constitutes the capacitor accommodating portion 40. The protruding portion 147*b* extends toward a portion of the terminal side of the capacitor 12 in the peripheral wall 142.

The antenna module 110 described above can obtain the following effects.

The base 111 is configured to be coupled by engagement with the first member 120 which includes a structure similar to that of the core accommodating portion 20 and the second member 130 which includes a structure similar to that of the capacitor accommodating portion 40. Therefore, assembly of the first member 120 and assembly of the second member 130 can be performed at a different place from each other or can be performed concurrently. The first member 120 is assembled by operation of attaching a magnetic core 15 to the corresponding portion of the core accommodating portion 20 and then winding the first electric wire 13 around the magnetic core 15. The second member 130 is assembled by operation of disposing the capacitor 12 on the corresponding portion of the capacitor accommodating portion 40 and then connecting the second terminal 12*c* of the capacitor 12 and the connecting portion 14*a* of the second electric wire 14 to each other.

Another Embodiment

In the first embodiment, the groove 44*a* for the first electric wire and the groove 44*b* for the first terminal are provided in the first holding portion 44. However, the grooves 44*a* and 44*b* can be formed into one groove. Specifically, a common groove into which the first electric wire 13 and the first terminal 12*b* are inserted can be provided in the first holding portion 44. For example, the width of the common groove is configured to be narrow toward the bottom wall 41 and one having small diameter among the first electric wire 13 and the first terminal 12*b* is disposed on the bottom wall 41 side. For the second holding portion 45, it may be changed similarly to the modified example of the first holding portion 44.

In the first embodiment and in the second embodiment, the antenna modules 10 and 110 are built into the outside handle 1. However, the disposition is not limited thereto. For example, the antenna modules 10 and 110 can be disposed on a door for a vehicle and an entrance of a vehicle.

(1) An antenna module according to an aspect of this disclosure includes a magnetic core; a first electric wire which constitutes a coil into which the magnetic core is inserted: a capacitor which has a first terminal and a second terminal and which is connected in series to the coil; a second electric wire which is connected to the capacitor; and a base which includes at least a capacitor accommodating portion in which the capacitor is accommodated and a core accommodating portion in which the magnetic core is accommodated. The capacitor accommodating portion has a first accommodating portion which accommodates at least one portion of the first terminal of the capacitor and a connecting portion of the first electric wire and a second accommodating portion which accommodates at least one portion of the second terminal of the capacitor and a connecting portion of the second electric wire. The first terminal of the capacitor and the connecting portion of the first electric wire are connected to each other in the first accommodating portion. The second terminal of the capacitor and the connecting portion of the second electric wire are connected to each other in the second accommodating portion. A portion of an opposite side to the connecting portion in the first electric wire and the second electric wire constitute a harness. According to this configuration, there are fewer connecting points and the structure thereof is simple compared to the antenna module of the related art.

(2) In the antenna module, the capacitor accommodating portion may include a third accommodating portion in which a main body portion of the capacitor is accommodated, in addition to the first accommodating portion and the second accommodating portion, and a first holding portion in which the first terminal of the capacitor and the first electric wire are held is provided between the third accommodating portion and the first accommodating portion and a second holding portion in which the second terminal of the capacitor and the second electric wire are held is provided between the third accommodating portion and the second accommodating portion. According to this configuration, when connecting there is no need to hold the terminal of the capacitor and the electric wire by a hand. In other words, this configuration contributes to simplification of the manufacturing process thereof.

(3) In the antenna module, the first holding portion may include a groove for the first terminal in which the first terminal of the capacitor is clamped and a groove for the first electric wire in which the first electric wire is clamped, and the second holding portion may include a groove for the second terminal in which the second terminal of the capacitor is clamped and a groove for the second electric wire in which the second electric wire is clamped. According to this configuration, the first terminal and the second terminal of the capacitor and the first electric wire and the second electric wire are held by a simple structure.

(4) In the antenna module, an extending direction of the groove for the first terminal and an extending direction of the groove for the first electric wire may intersect with each other and an extending direction of the groove for the second terminal and an extending direction of the groove for the second electric wire may intersect with each other. According to this configuration, the terminal of the capacitor and a connecting portion of the electric wire are connected to each other well.

(5) In the antenna module, the capacitor accommodating portion may be filled with sealing resin. According to this configuration, water is prevented from adhering to the capacitor and the connecting portion of the electric wire.

(6) In the antenna module, the capacitor accommodating portion may include a guide claw which guides the second electric wire, and the second electric wire may be wound around the guide claw. According to this configuration, due to the tension of the second electric wire, stress applied to a connecting portion between the connecting portion of the second electric wire and the second terminal of the capacitor is reduced.

(7) In the antenna module, the base may be configured as an integral component with respect to the capacitor accommodating portion and the core accommodating portion, and the antenna module may have a fewer number of components as compared to when being configured as separate bodies.

(8) In the antenna module, the base may include a first member which includes the core accommodating portion and a second member which includes the capacitor accommodating portion, and the first member and the second member may be coupled to each other by engaging.

The antenna module has a simple structure.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An antenna module comprising:

a magnetic core;

a first electric wire which constitutes a coil into which the magnetic core is inserted;

a capacitor which has a first terminal and a second terminal and which is connected in series to the coil;

a second electric wire which is connected to the capacitor; and a base which includes at least a capacitor accommodating portion in which the capacitor is accommodated and a core accommodating portion in which the magnetic core is accommodated, wherein the capacitor accommodating portion has a first accommodating portion which accommodates at least one portion of the first terminal of the capacitor and a connecting portion of the first electric wire and a second accommodating portion which accommodates at least one portion of the second terminal of the capacitor and a connecting portion of the second electric wire, wherein the capacitor accommodating portion has a partition wall provided between the first accommodating portion and the second accommodating portion, wherein the first terminal of the capacitor and the connecting portion of the first electric wire are connected to each other in the first accommodating portion, wherein the second terminal of the capacitor and the connecting portion of the second electric wire are connected to each other in the second accommodating portion, and wherein a portion of an opposite side to the connecting portion in the first electric wire and the second electric wire constitute a harness.

2. The antenna module according to claim 1, wherein the capacitor accommodating portion includes a third accommodating portion in which a main body portion of the capacitor is accommodated, in addition to the first accommodating portion and the second accommodating portion, wherein a first holding portion in which the first terminal of the capacitor and the first electric wire are held is provided between the third accommodating portion and the first accommodating portion, and wherein a second holding portion in which the second terminal of the capacitor and the second electric wire are held is provided between the third accommodating portion and the second accommodating portion.

3. The antenna module according to claim 2, wherein the first holding portion includes a groove for the first terminal in which the first terminal of the capacitor is clamped and a groove for the first electric wire in which the first electric wire is clamped, and the second holding portion includes a groove for the second terminal in which the second terminal of the capacitor is clamped and a groove for the second electric wire in which the second electric wire is clamped.

4. The antenna module according to claim 3, wherein an extending direction of the groove for the first terminal and an extending direction of the groove for the first electric wire intersect with each other and an extending direction of the groove for the second terminal and an extending direction of the groove for the second electric wire intersect with each other.

5. The antenna module according to claim 1, wherein the capacitor accommodating portion is filled with sealing resin.

6. The antenna module according to claim 1, wherein the capacitor accommodating portion includes a guide claw which guides the second electric wire, and wherein the second electric wire is wound around the guide claw.

7. The antenna module according to claim 1, wherein the base is configured as an integral component with respect to the capacitor accommodating portion and the core accommodating portion.

8. The antenna module according to claim 1, wherein the base includes a first member which includes the core accommodating portion and a second member which includes the capacitor accommodating portion, and wherein the first member and the second member are coupled to each other by engaging.

9. An antenna module comprising:

a magnetic core;

a first electric wire which constitutes a coil into which the magnetic core is inserted;

a capacitor which has a first terminal and a second terminal and which is connected in series to the coil;

a second electric wire which is connected in series to the capacitor; and a base which includes at least a capacitor accommodating portion in which the capacitor is accommodated and a core accommodating portion in which the magnetic core is accommodated, wherein the capacitor accommodating portion has a first accommodating portion which accommodates at least one portion of the first terminal of the capacitor and a connecting portion of the first electric wire and a second accommodating portion which accommodates at least one portion of the second terminal of the capacitor and a connecting portion of the second electric wire, wherein land members made from a metal plate or a plate including a metal layer are disposed on the first accommodating portion and the second accommodating portion, wherein the first terminal of the capacitor and the connecting portion of the first electric wire are connected to each other on the land member in the first accommodating portion, wherein the second terminal of the capacitor and the connecting portion of the second electric wire are connected to each other on the land member in the second accommodating portion, and wherein a portion of an opposite side to the connecting portion in the first electric wire and the second electric wire constitute a harness.

* * * * *